US007677937B2

(12) United States Patent
Ishida et al.

(10) Patent No.: US 7,677,937 B2
(45) Date of Patent: Mar. 16, 2010

(54) OPERATOR CONTROL SYSTEM OF BOAT

(75) Inventors: Yasuhiko Ishida, Hyogo (JP); Yasuji Sekimoto, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 0 days.

(21) Appl. No.: 11/715,899

(22) Filed: Mar. 9, 2007

(65) Prior Publication Data

US 2008/0085640 A1 Apr. 10, 2008

(30) Foreign Application Priority Data

Oct. 5, 2006 (JP) ..... 2006-273972

(51) Int. Cl.
*B63H 21/22* (2006.01)
*B63H 23/00* (2006.01)
*B60L 3/00* (2006.01)
*B60L 15/00* (2006.01)

(52) U.S. Cl. ..... 440/1; 701/21

(58) Field of Classification Search ..... 440/1, 440/2, 53, 84; 74/480 R; 701/21
See application file for complete search history.

(56) References Cited

U.S. PATENT DOCUMENTS 5,214,363 A * 5/1993 Wisner et al. ..... 318/588
6,273,771 B1 * 8/2001 Buckley et al. ..... 440/84
6,431,930 B1 * 8/2002 Holt ..... 440/84
6,801,839 B2 * 10/2004 Kaji ..... 701/21
6,910,927 B2 * 6/2005 Kanno ..... 440/1
7,108,570 B2 * 9/2006 Okuyama ..... 440/84
7,280,904 B2 * 10/2007 Kaji ..... 701/101
2006/0240720 A1 * 10/2006 Yamashita et al. ..... 440/1
2006/0293807 A1 * 12/2006 Okuyama ..... 701/21
2007/0017426 A1 * 1/2007 Kaji et al. ..... 114/144 RE
2007/0178779 A1 * 8/2007 Takada et al. ..... 440/61 S
2008/0003898 A1 * 1/2008 Watanabe et al. ..... 440/84

FOREIGN PATENT DOCUMENTS

JP 2000-313398 A 11/2000

* cited by examiner

*Primary Examiner*—Daniel V Venne
(74) *Attorney, Agent, or Firm*—Sughrue Mion, PLLC

(57) ABSTRACT

An operator control system for a boat, where an outboard motor includes a throttle actuator that controls throttle opening of the engine, a shift actuator that controls a shift position to be put into one of neutral, drive, and reverse positions, and an engine control unit that controls the engine. An operation input portion, to control propulsion of the outboard motor and an operation quantity computation portion, that computes control command values including a start and a stop, the throttle opening, and the shift position of the outboard motor by detecting a steering state of a boat driver at the steering seat, are mounted on an operator station. The operation quantity computation portion transmits the control command values to the outboard motor via a communication portion, and the outboard motor performs control of the start and the stop, the throttle opening, and the shift position of the engine according to the control command values received.

6 Claims, 6 Drawing Sheets

OPERATOR CONTROL SYSTEM OF BOAT

BACKGROUND OF THE INVENTION

1. Field of the Invention

The present invention relates to a sailing control system of a boat equipped with one or more than one outboard motor including an engine and one or more than one operator station to control the hull.

2. Background Art

A boat, such as a motor boat, is equipped with an outboard motor including an engine serving as a boat propeller at the aft of the hull. An electrical signal line from an engine control unit is connected to a start switch (hereinafter, abbreviated to SW) and a stop SW mounted at the operator station, so that the boat driver is able to start and stop the engine under his control.

The throttle actuator and the shift actuator of the outboard motor are mechanically connected to the control lever provided at the operator station via a wire cable. A shift cable is provided to put the shift actuator into neutral, drive, or reverse. A throttle cable is provided to control the throttle opening for the outboard motor. With these components, the boat driver directly controls the throttle opening and the shift position of the outboard motor using the control lever.

As has been described, a typical sailing control system of a boat in the related art is formed by linking the control lever at the operator station to the throttle actuator and to the shift actuator in the outboard motor via the mechanical cable mechanism.

In order to assist the boat driver in control power with the system configuration described above, there has been a proposal to interpose a driving motor and a driving unit between the control lever and the cable.

Also, in some cases, a boat propulsion system that omits the mechanical cable between the operator station and the outboard motor, and instead detects a quantity of lever operations at the operator station using a control unit (ECU) in the outboard motor has been proposed as is disclosed, for example, in JP-A-2000-313398.

In the related art, when the outboard motor is equipped to the hull, a mechanism that pushes and pulls the wire cable and the wire connecting the operator station and the outboard motor and a harness component for SW signal lines and the harness for the power supply system are necessary. In the case of a boat, these components occupy a large proportion of the interior of the boat. Moreover, when the outboard motor is attached to the hull, a large number of man-hours and a long adjustment time are required to mechanically connect the throttle and the wire cable for shift operations.

In addition, when more then one operator station is installed, the mechanical configuration around the wire cable becomes more complex, which causes both the man-hours and the cost needed to attach the outboard motors to increase.

Further, should a mechanical error occur in a component forming the mechanism that pushes and pulls the wire cable and wire, it becomes difficult to detect such an error. In the event of an error, the boat driver has to make a determination from the behavior of the hull.

Furthermore, in the case of the system to detect the boat steering state at the operator station using the ECU in the outboard motor by merely omitting the mechanical cable, the line length of a signal line used to prevent a malfunction caused by electrical noises is limited, and the distance between the operator station and the outboard motor has to be shortened. As a consequence, the installation location of the operator station in the hull is limited.

Hence, this system is not applicable to a case where two operator stations are installed, for example, one at the first deck and the other at the second deck. In addition, once noises are superimposed on the signal line used to transmit a detected quantity of operations on the control lever at the operator station, it is difficult to make a distinction between the noises and the signal. This poses a problem that there is a risk of a malfunction of the outboard motor.

SUMMARY OF THE INVENTION

The invention was devised to solve the problems discussed above, and therefore has an advantage to provide a sailing control system of a boat capable of making the operations during the steering of the boat easier while ensuring safety of the boat at the occurrence of a failure by intensively controlling the outboard motor, and at the same time, reducing the number of components, the man-hours, and the cost needed at the time of attachment of the outboard motor.

A sailing control system of a boat according to one aspect of the invention is equipped with one or more than one outboard motor including an engine and one or more than one operator station to control a hull. The outboard motor includes a throttle actuator that controls throttle opening for the engine, a shift actuator that controls a shift position to be put into one of neutral, drive, and reverse positions, and an engine control unit that controls the engine. At the operator station are mounted an operation input portion to control propulsion of the outboard motor and an operation quantity computation portion that computes control command values including a start and a stop, the throttle opening, and the shift position of the outboard motor by detecting a steering state of the boat hull based on steering input from a driver at the operator station. The operation quantity computation portion transmits the control command values to the outboard motor via a communication portion, and the outboard motor is controlled based on the control command values received for the start and the stop, the throttle opening, and the shift position of the engine.

According to the sailing control system of a boat of the invention, the sailing control system of a boat can be formed without using components forming a mechanism that pushes and pulls a mechanical wire cable and a wire. Also, because the engine control unit and the steering device in the outside motor can be connected to the operation quantity computation portion mounted on the operator station via a communication line alone, not only can the number of man-hours at the time of rigging be reduced in comparison with the case of using the mechanical wire cable, but also the number of attaching components can be reduced markedly. It is thus possible to provide a boat with low rigging costs.

In addition, because the components forming the mechanism that pushes and pulls the mechanical wire cable and the wire are unnecessary, the system configuration can be changed with relative ease, for example, by adding or removing the operator station or by adding or removing the outboard motor.

The foregoing and other objects, features, aspects, and advantages of the present invention will become more apparent from the following detailed description of the present invention when taken in conjunction with the accompanying drawings.

DETAILED DESCRIPTION OF THE INVENTION EMBODIMENT

Hereinafter, one embodiment of the invention will be described with reference to the drawings.

Figure 1:
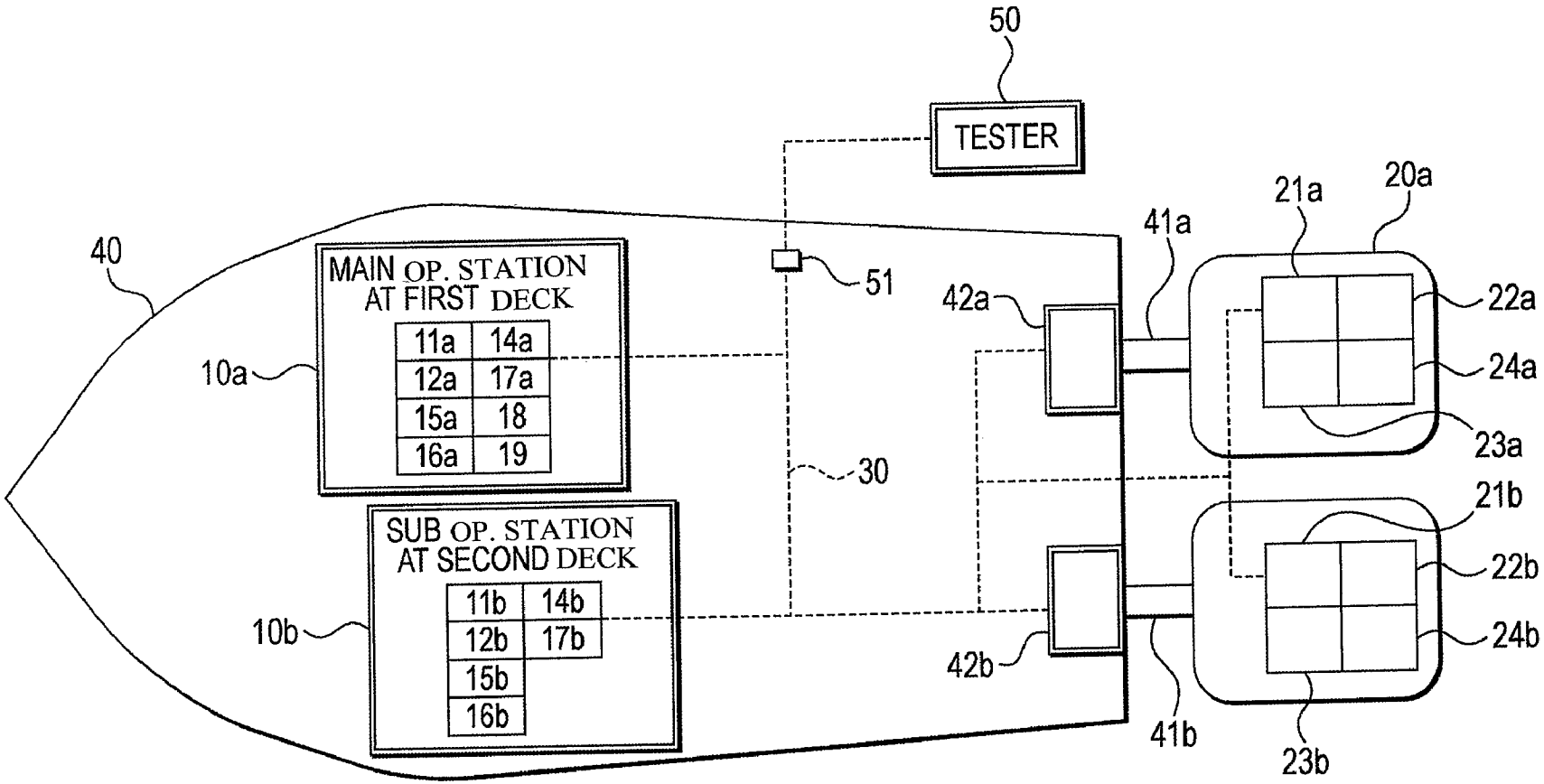
FIG. 1 is a view schematically showing the configuration of operator stations, outboard motors, and peripheral equipment in a small boat to which a sailing control system of a boat according to one embodiment of the invention is applied.

FIG. 1 is a view schematically showing the configuration of a boat, operator stations, and outboard motors to which a sailing control system of a small boat according to one embodiment of the invention is applied. It shows a case where the hull comprises a first deck and a second deck with two operator stations being installed, one at each deck, and two outboard motors are attached to the hull.

The boat shown in FIG. 1 comprises a hull 40, outboard motors 20*a* and 20*b* including engines attached to the aft of the hull 40 with brackets 41, and a main operator station 10*a* and a sub operator station 10*b* installed inside the hull 40. The operator stations 10*a* and 10*b* are installed in remote locations, respectively, at the first deck and the second deck of the hull 40, and steering of the boat is enabled from either operator station chosen by the boat driver.

The main operator station 10*a* is provided on the first deck of the hull 40. A control lever 11*a*, to control a shift change and propulsion of the outboard motors 20*a* and 20*b*, a power supply SW 18, an engine start SW 15*a* and an engine stop SW 16*a* of the outboard motor, a driving SW 17*a*, such as a selection switch SW to choose the main operator station 10*a*, and a steering device 12*a* to control the propelling direction of the boat, are mounted on the main operator station 10*a*.

A main operation quantity computation portion (hereinafter, referred to as main BCM) 14*a* is also mounted on the main operator station 10*a* and is provided to process an operation state of the boat, as detected by the steering device 12*a*, to compute control command values for the outboard motors 20*a* and 20*b*. The main BCM 14*a* constantly monitors the driving state of the outboard motors. In addition, the main BCM 14*a* includes a warning device 19, such as a buzzer and a lamp, to give a warning to the boat driver upon detection of an abnormal state in the system. The main BCM 14*a* drives the warning device 19.

The sub operator station 10*b* is provided on the second deck of the hull 40. A control lever 11*b* to control a shift change and propulsion of the outboard motors 20*a* and 20*b*, an engine start SW 15*b* and an engine stop SW 16*b* of the outboard motors 20*a* and 20*b*, a driving SW 17*b*, such as a selection SW to choose the sub operator station 10*b*, and a steering device 12*b* to control the propelling direction of the boat, are mounted on the sub operator station 10*b*.

A sub operation quantity calculation portion (hereinafter, referred to as sub BCM) 14*b* is also mounted on the sub operator station 10*b*. The sub BCM 14*b* is provided to detect an operation state of the boat, as detected in the steering device 12*b*, and to transmit the detected values to the main BCM 14*a* at the main operator station 10*a*.

The outboard motor 20*a* is provided to the right aft (starboard) of the hull 40 and the outboard motor 20*b* is provided to the left aft (port) of the hull 40. The outboard motor 20*a* on the starboard includes an engine 22*a*, a throttle actuator 23*a* that controls the throttle opening to control an engine output by adjusting a quantity of intake air to the engine 22*a*, and a shift actuator 24*a* that changes the shift position into neutral, drive and reverse. The outboard motor 20*a* also includes an engine control unit (hereinafter, abbreviated to ECU) 21*a* that controls the engine 22*a*, the throttle actuator 23*a*, and the shift actuator 24*a*.

The outboard motor 20*b* on the port includes an engine 22*b*, a throttle actuator 23*b* that controls an engine output by adjusting a quantity of intake air to the engine 22*b*, and a shift actuator 24*b* that changes the shift position into neutral, drive and reverse. The outboard motor 20*b* also includes an ECU 21*b* that controls the engine 22*b*, the throttle actuator 23*b*, and the shift actuator 24*b*.

The outboard motors 20*a* and 20*b* are connected to the hull 40 with the brackets 41*a* and 41*b*, respectively, and control the propelling direction of the hull 40 by controlling the angles of the outboard motors 20*a* and 20*b* from side to side using steering devices 42*a* and 42*b*, respectively. Steering quantities of the outboard motors 20*a* and 20*b* by the steering devices 42*a* and 42*b*, respectively, are controlled according to control command values from the main BCM 14*a* at the main operator station 10*a*.

It is configured in such a manner that the main BCM 14*a*, the sub BCM 14*b*, the ECU's 21*a* and 21*b*, the steering devices 42*a* and 42*b* are interconnected via a CAN communication line 30 to enable mutual data receptions and transmissions. It is also configured in such a manner that a diagnostic connection connector 51 is provided to the CAN communication line 30 for a diagnostic unit 50 to be connected thereto when a need arises to enable settings and a diagnosis of the system.

As has been described, the respective devices are interconnected via the electrical signal line alone, and no mechanical cable is present in this configuration.

Figure 2:
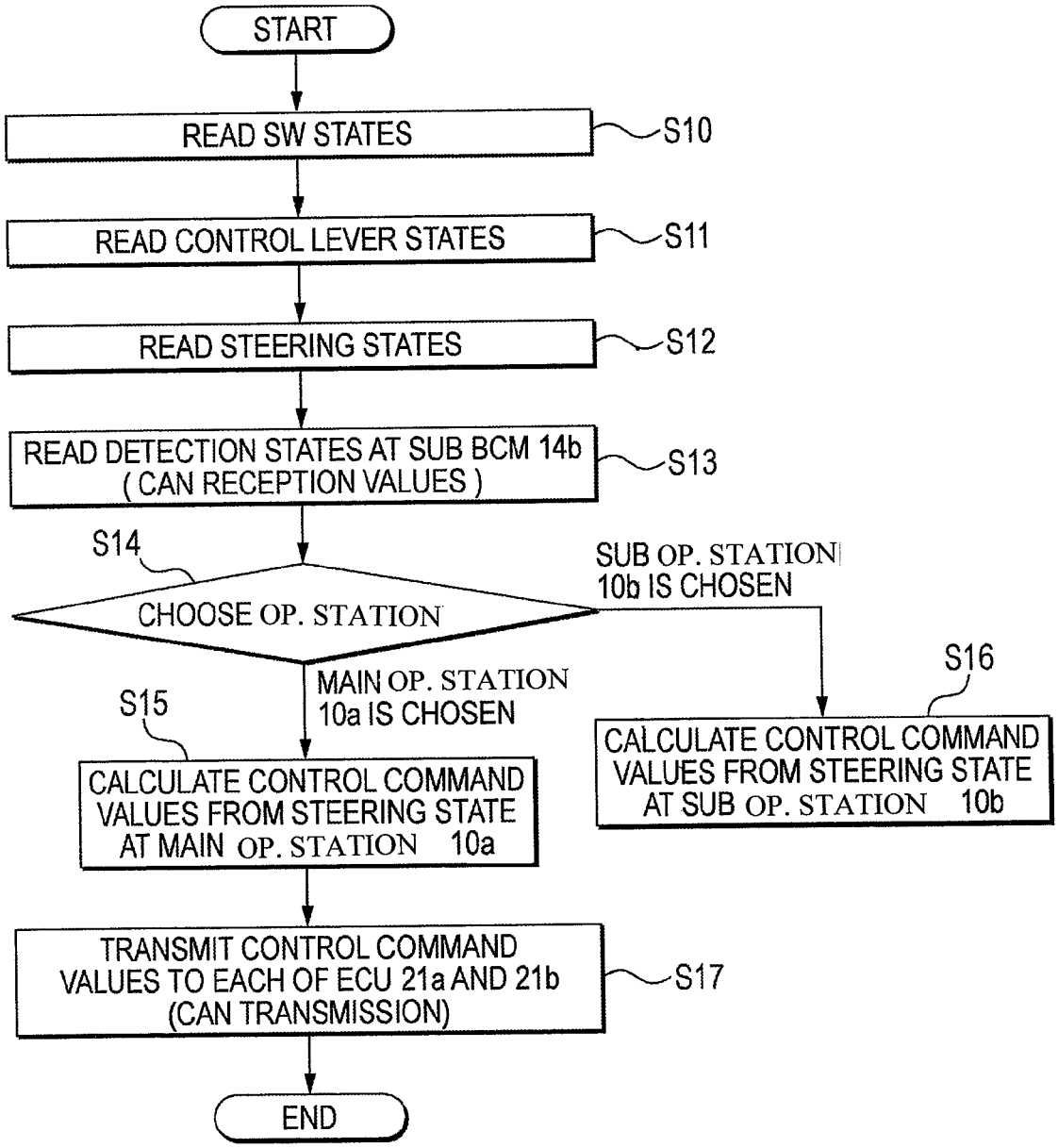
FIG. 2 is a flowchart showing the procedure of computing control command values in a main BCM of the sailing control system according to the embodiment of the invention.

A procedure of computing the control command values for the outboard motors 20*a* and 20*b* in the main BCM 14*a* of the sailing control unit according to this embodiment of the invention will now be described with reference to the flowchart of FIG. 2.

In Step S10, the respective SW states mounted at the main operator station 10*a* at the first deck are read, and the SW operation state values (ON/OFF) by the boat driver are stored in an internal memory. The state of the control lever 11*a* and the state of the steering device 12*a* are read and stored in the internal memory in Step S11 and Step S12, respectively. In Step S13, the state detected in the sub BCM 14*a* mounted on the sub operator station 10*b* at the second deck is received through a CAN communication and stored in the internal memory.

Figure 3:
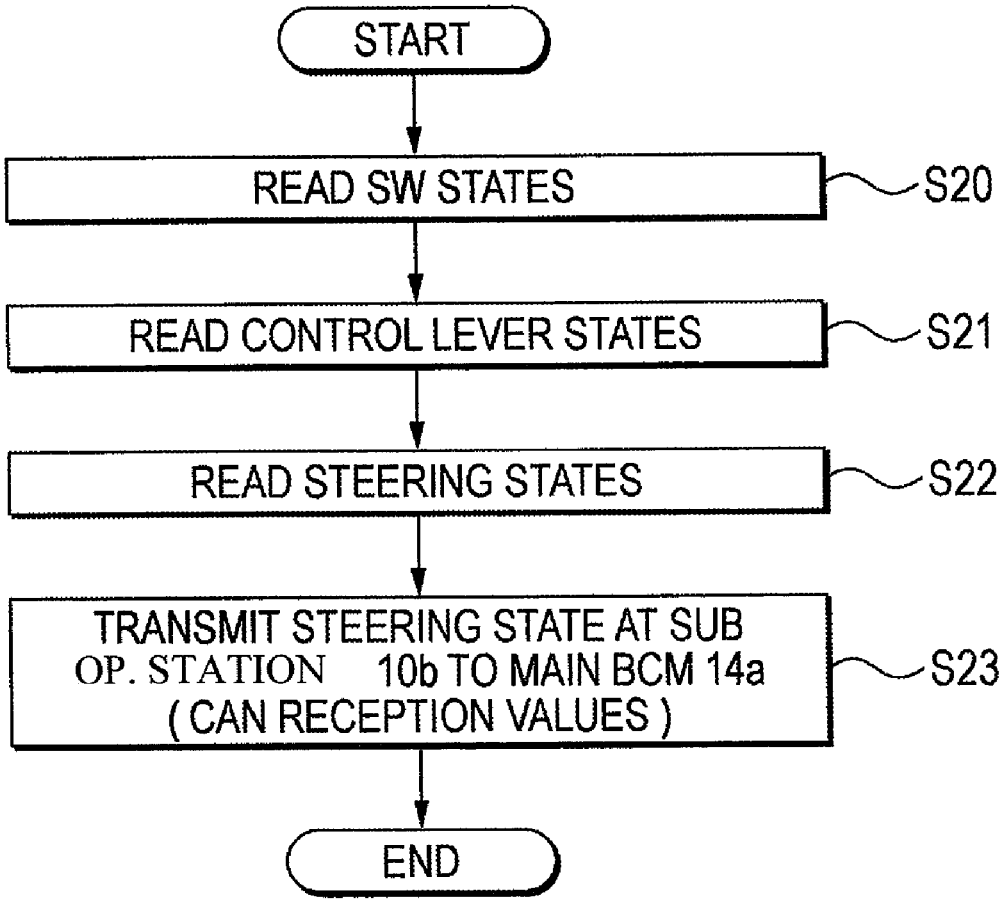
FIG. 3 is a flowchart showing the procedure of processing in a sub BCM of the sailing control system according to the embodiment of the invention.

The content of processing by the sub BCM 14*b* mounted on the sub operator station 10*b* is shown in FIG. 3. More specifically, the respective SW states and the states of the control lever 11*b* and the steering device 12*b* are read in Steps S20, S21, and S22, respectively, and in Step S23, the steering state of the hull of the boat is transmitted from the sub operator station 10*b* to the main BCM 14*a* through a CAN communication.

In Step S14, the states of the selection SW's 17*a* and 17*b* mounted, respectively, on the main operator station 10*a* at the first deck and the sub operator station 10*b* at the second deck are confirmed. The main BCM 14*a* determines the operator station data from the one whose SW state comes ON from OFF as being valid. The switching of the operator stations in this instance is allowed only when the engines in all the outboard motors are rotating at the rotating speed as high as or slower than the idling speed and the shift is put into the neutral state before the switching and immediately after the switching, and the switching of the operator stations is inhibited in any other state.

For example, in a case a switching is to be made to the sub operator station 10*b* while the boat is driven at the main operator station 10*a*, the switching is not allowed unless the control command values for the outboard motors at the main operator station 10*a* and the sub operator station 10*b* indicate that the shift position is put into neutral and the throttle opening command values for the both engines indicate a fully closed state. The ON operation for the driving SW 17*b* is thus ignored and the operation at the main operator station 10*a* is continued. This prevents an abrupt starting caused by the switching of the operator stations.

In a case where the main operator station 10*a* is chosen, in Step S15, the main BCM 14*a* computes the control command values for the outboard motors 20*a* and 20*b* on the basis of the detection values at the main operator station 10*a*. In a case where the sub operator station 10*b* is chosen, in Step S16, the main BCM 14*a* computes the control command values for the outboard motors 20*a* and 20*b* on the basis of the detection values at the sub operator station 10*b*. The control command values computed in this instance include the start command, the stop command, the throttle opening, the shift position of each outboard motor engine, and the steering angle of each outboard motor. Having computed the control command values, the main BCM 14*a* transmits the control command values to the ECU's 21*a* and 21*b* and the steering devices 42*a* and 42*b* through CAN communications in Step S17.

Upon receipt of the steering angle commands through the CAN communications, the steering devices 42*a* and 42*b* control the steering angles of the outboard motors 20*a* and 20*b*, respectively, according to the control command values, such that the boat is driven in an intended propelling direction. Upon receipt of the start command through the CAN communications, the ECU's 21*a* and 21*b* of the outboard motors start the engines by activating the engine starters in the outboard motors. Upon receipt of the stop command, the ECU'S 21*a* and 21*b* stop the engine control (stop the fuel supply and the ignition control), and bring the outboard engines into a stopped state. Also, the throttle actuators 23*a* and 23*b* and the shift actuators 24*a* and 24*b* are controlled according to the specified throttle openings and shift values to enable the control of the engine output and propulsion as the boat driver intended.

In a case where the system configuration is registered and set in the respective BCM's 14*a* and 14*b* and ECU's 21*a* and 21*b* at the time of rigging when the outboard motors 20*a* and 20*b* are equipped or attached to the boat, the diagnostic unit 50 for exclusive use is connected to the diagnostic connection connector 51 of the CAN communication line 30. Then, the state of the system configuration, such as the number of operator stations, the number of outboard motors, and their own installment locations and roles, are stored in the respective BCM's 14*a* and 14*b* and ECU's 21*a* and 21*b*, more specifically, in the internal non-volatile memories (for example, EEPROM) of the respective BCM's 14*a* and 14*b* and ECU's 21*a* and 21*b* according to the specified values from the diagnostic unit 50. Thereafter, the respective BCM's 14*a* and 14*b* and ECU's 21*a* and 21*b* are able to understand their own roles from the stored values at the time of start-ups, and perform specified processing. This makes it possible to set and change the system configuration flexibly, which can in turn reduce the number of man-hours, the cost, and the number of components at the time of rigging.

The BCM 14*a* registered as the main BCM confirms the connections with the sub BCM 14*b* and the ECU's 21*a* and 21*b* at the time of the system start-up when the power supply is switched ON by checking whether a normal response is received through CAN communications on the basis of the state of the system configuration registered in the internal non-volatile memory (for example EEPROM). Having confirmed that the connections are normal, the main BCM 14*a* determines that the sailing is allowed, and transmits the control command values to the ECU's 21*a* and 21*b* according to the operation of the boat driver to enable the boat to sail. In a case where the main BCM 14*a* confirms that the sub BCM 14*b* or any ECU has failed to return a normal response, it gives a warning to the boat driver by means of the warning device 19, such as a buzzer and a lamp, to let the boat driver become aware of the presence of an abnormality in the boat system.

Regarding the CAN communications, the BCM's 14*a* and 14*b* and the ECU's 21*a* and 21*b* in the sailing control system constantly exchange data mutually while the power supply stays ON. The ECU's 21*a* and 21*b* respectively in the outboard motors 20*a* and 20*b* control the outboard motors 20*a* and 20*b* according to the control command values, such as the target throttle opening and shift position, transmitted from the main BCM 14*a* periodically (every 5 ms) through the CAN communications, and transmit the state of the engine control, such as the engine rotating speeds, the actual throttle openings, and the actual shift positions of the outboard motors 20*a* and 20*b*, to the main BCM 14*a* periodically (every 10 ms).

A method of determining the shift positions and the throttle openings in the ECU's 21*a* and 21*b* according to the CAN reception values (control command values) from the main BCM 14*a* will now be described with reference to the flowchart of FIG. 4.

Figure 4:
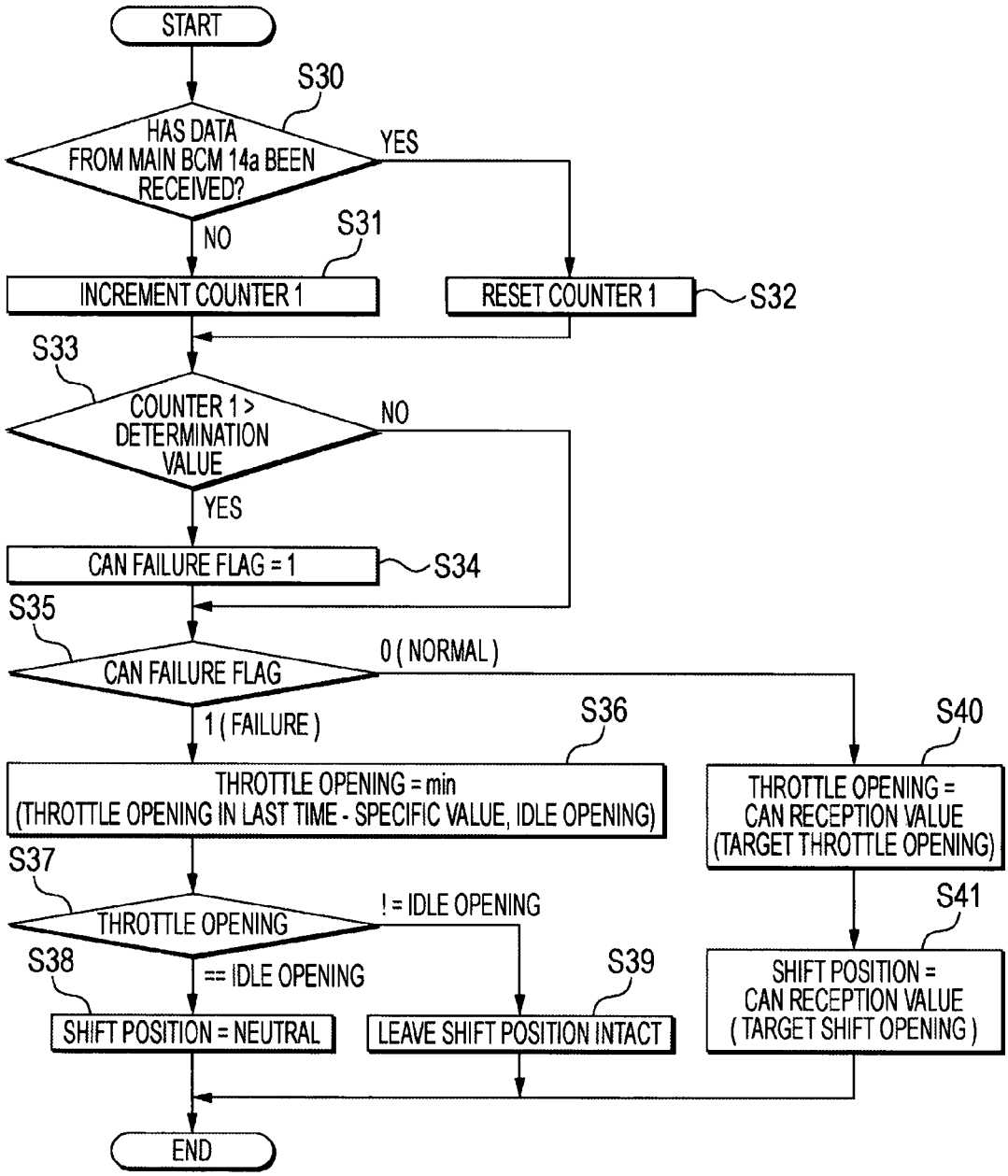
FIG. 4 is a flowchart showing a method of determining the shift position and the throttle opening in the ECU using CAN reception values from the main BCM of the sailing control system according to the embodiment of the invention.

The flow of FIG. 4 is configured to cause processing to be performed periodically (every 5 ms). Initially, in Step S30, each ECU confirms whether the control command values (throttle openings, the shift positions, and so forth) transmitted from the BCM 14*a* periodically (every 5 ms) have been received at this point in time.

When the control command values have not been received, the ECU counts up a counter 1 used to determine a CAN failure by one in Step S31. When the control command values are received normally, the ECU resets the counter 1 to 0 in Step S32.

In Step S33, the ECU confirms whether the value in the counter 1 reaches or exceeds a specific determination value. Upon confirming that the value has reached or exceeded the determination value (that is, a specific time), the ECU determines a CAN failure and sets a CAN failure flag in Step S34.

In Step S35, the ECU confirms the state of the CAN failure flag, and when the flag is not set, it determines that CAN communications are normal, and in Steps S40 and S41, it sets the target throttle openings and shift positions used for the control according to the control command values in the CAN receptions.

Upon confirming that the CAN failure flag is set in Step S35, the ECU decreases the current throttle openings (values set in the last time) by a specific value, and keeps decreasing them step-by-step until they reach the idle opening in Step S36.

In Step S37, the ECU confirms whether the throttle openings found in Step S36 have reached the idle opening. When the throttle openings reached the idle opening, the ECU puts the target shift position used for the control to a neutral state in Step S38. When the throttle openings have not reached the idle opening, the ECU leaves the shift position intact (at the values set in the last time) in Step S39.

Figure 5:
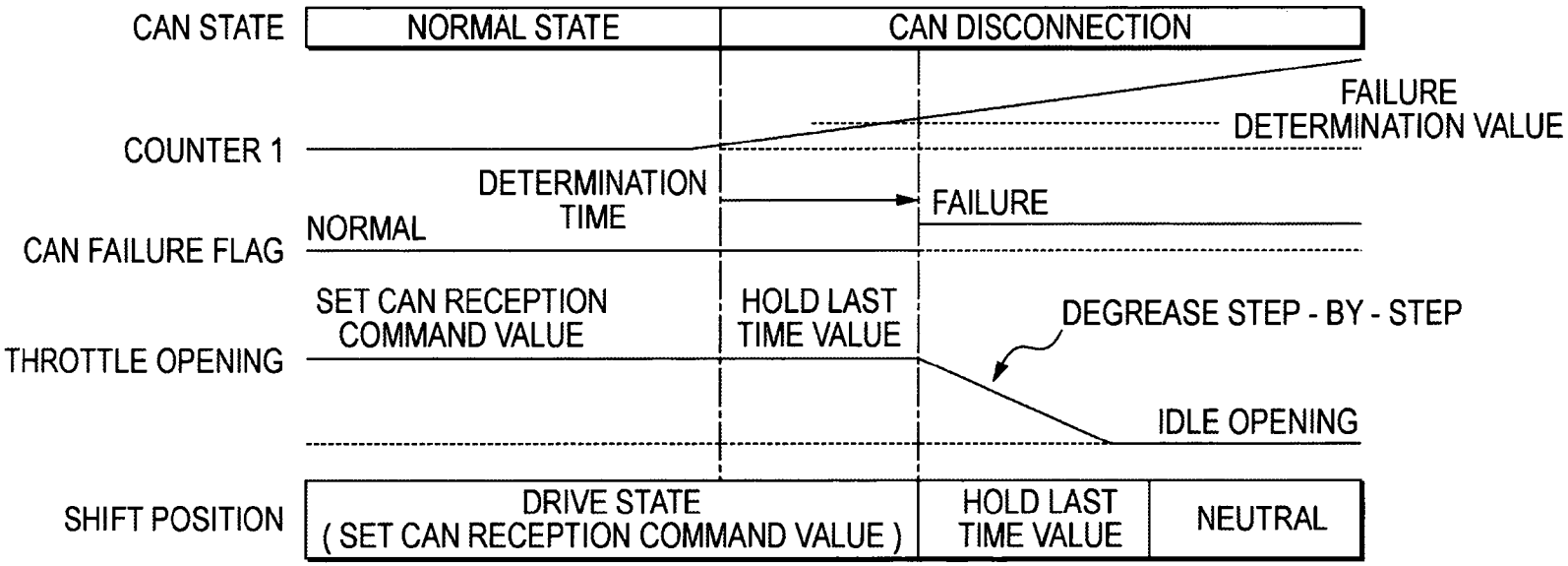
FIG. 5 is a time chart showing a state of throttle opening and shift position command values in the ECU at the occurrence of a CAN failure in the sailing control system according to the embodiment of the invention.

Once a failure is determined, the failure state is maintained and released when the engine is stopped, so that the failure state is not released even when the CAN communications are restored to a normal state. This configuration enables the boat to undergo a transition to a stopped state safely should a failure such that repetitively causes a disconnection and a restoration of the CAN occur. It is thus possible to prevent the occurrence of an abrupt acceleration caused by a restoration of the CAN. The content of processing at the time of a CAN failure in Step S35 through S39 is set forth in the time chart of FIG. 5.

The main BCM 14*a* constantly monitors the operation states of the respective outboard motors 20*a* and 20*b* on the basis of CAN reception values from the ECU's 21*a* and 21*b*. Upon detection of a system failure, the main BCM 14*a* stops the outboard engines and inform the boat driver of the system failure by means of the warning device 19, such as a buzzer and a lamp.

Figure 6:
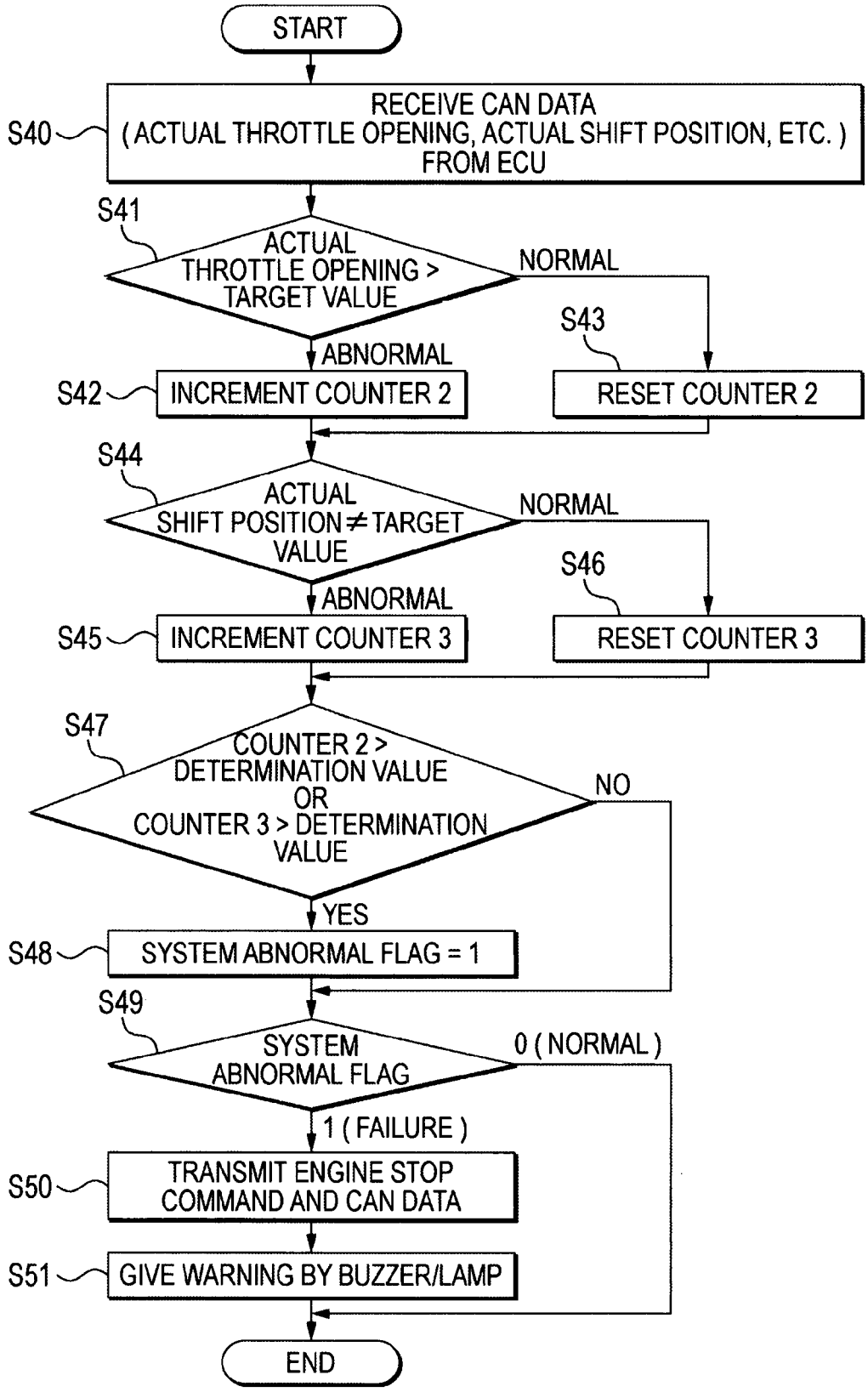
FIG. 6 is a flowchart showing a procedure of monitoring the system by the main BCM of the sailing control system according to the embodiment of the invention.

The procedure of the system monitoring by the main BCM 14*a* will now be described with reference to the flowchart of FIG. 6. The flow of FIG. 6 is configured to cause processing to be performed periodically (every 5 ms), and determinations are made independently for the outboard motors 20*a* and 20*b*.

Initially, in Step S40, upon receipt of the driving state values (the actual throttle opening value, the actual shift position, the engine rotating speed, and so forth) transmitted from the outboard ECU through CAN communications, the main BCM 14*a* gains an understanding of the engine state. In Step S41, the main BCM 14*a* monitors the actual throttle opening of the engine, and compares the actual throttle opening of the engine received in Step S40 with the throttle opening (target value) specified to the engine, and determines an abnormality when the relation, actual throttle opening>the target value, is established. Upon determination of an abnormality, the main BCM 14*a* increments a counter 2 used to detect an abnormality in Step S42. Upon determination of no abnormality, the main BCM 14*a* resets the counter 2 used to detect an abnormality in Step S43.

In Step S44, the main BCM 14*a* monitors the actual shift position of the engine. The main BCM 14*a* first compares the actual shift position of the engine received in Step S40 with the shift position (target value) specified to the engine, and determines an abnormality when the relation, actual shift position≠target value, is established. Upon determination of an abnormality, the main BCM 14*a* increments a counter 3 used to detect an abnormality in Step S45. Upon determination of no abnormality, the main BCM 14*a* resets the counter 3 used to detect an abnormality in Step S46.

In Step S47, the main BCM 14*a* confirms the counters 2 and 3 used to detect an abnormality. When the value in the counter 2 or 3 used to detect an abnormality exceeds a determination value, the main BCM 14*a* determines the occurrence of an abnormality of some kind within the system, and sets a system abnormality flag in Step S48.

Subsequently, the main BCM 14*a* confirms the system abnormality flag in Step S49. When the system abnormality flag is not set, the main BCM 14*a* determines that the system is operating normally. When the system abnormality flag is set, the BCM 14*a* transmits an engine stop command to the engine of the outboard motor with which the abnormality has been determined to stop the engine in Step S50. In Step S51, the main BCM 14*a* also gives a warning of an abnormal state to the boat driver by means of the warning device 19, such as a buzzer and a lamp.

As has been described, a sailing control system of a boat according to one aspect of the invention is equipped with one or more than one outboard motor including an engine and one or more than one operator station to control a hull. The outboard motor includes a throttle actuator that controls throttle opening of the engine, a shift actuator that controls a shift position to be put into one of neutral, drive, and reverse positions, and an ECU that controls the engine. At the operator station are mounted an operation input portion to control propulsion of the outboard motor and a BCM that computes control command values including a start and a stop, the throttle opening, and the shift position of the outboard motor by detecting a steering state of a hull based on steering input from a boat driver at the operator station. The BCM transmits the control command values to the outboard motor via a communication portion, and the outboard motor is controlled based on the control command values received for the start and the stop, the throttle opening, and the shift position of the engine. Hence, because it is possible to omit a large portion of the mechanical wire cable and the components forming the mechanical mechanism that are necessary in the related art, a space in the hull occupied by these components can be reduced. Also, the man-hours and the cost needed to attach the outboard motor to the hull can be reduced.

According to this aspect of the invention, it is configured in such a manner that: the operator station is provided in a plural form and one is used as a main operator station and another is used as a sub operator station; the BCM is mounted at the main and sub operator stations; the BCM mounted on the sub operator station detects the steering state of the hull based on steering input from a boat driver and transmits the detected steering state to the BCM mounted at the main operator station by means of the communication portion; and the BCM mounted at the main operator station computes most appropriate values as the control command values from operation states of all the operator stations. Hence, even when the operator stations are installed at two locations, there will be no unstable behaviors of the outboard motors caused by a difference of the control command values, and the interior of the hull can be managed comprehensively. It is thus possible to switch the operator stations smoothly. In addition, the invention can address a case where three or more operator stations are provided with ease, and can therefore handle various boat configurations flexibly without the need to provide additional mechanical cables and mechanisms.

According to this aspect of the invention, it is configured in such a manner that, at a time of rigging to incorporate the outboard motor, the operator station, and the BCM into the hull, the number of outboard motors, the number of BCM's, and an installment location of the ECU to be attached to the boat, and their own roles are registered in the ECU and the BCM by a diagnostic unit connected to the boat from a remote location, and that the ECU and the BCM store registered information into internal non-volatile memories, so that each operates according to memory values after a start-up when a power supply is switched ON. Hence, at the time of assembly of the hull, the system configuration information about the number of outboard motors and the number of operator stations attached to the hull, the installment location of the ECU, and the role of the BCM are set in the BCM and the ECU by the remotely located diagnostic unit, and because the information thus set is held in the internal non-volatile memory, it is possible to set or change the system configuration with ease.

According to this aspect of the invention, it is configured in such a manner that the BCM registered for the main operator station through registration by the diagnostic unit confirms whether the ECU is normal at a system start-up when the power supply is switched ON through a transmission and a reception of data by means of the communication portion, and in a case where the ECU or any other BCM fails to reply, the BCM determines a system abnormal state and gives a warning of an abnormal state to the boat driver. Hence, by confirming whether the ECU and the sub BCM are operating normally at the start-up when the power supply is switched ON through a reception and a transmission of CAN communication data, it is possible to detect an abnormality before the driving of the boat starts. Also, in the case of an abnormality, a warning is displayed by means of a buzzer or a lamp for the boat driver to notice. An abnormality can be therefore detected before the boat is sailed in a case where the CAN communication line has an abnormality or the respective ECU's have an abnormality. It is thus possible to forestall a sailing in an abnormal state.

According to this aspect of the invention, it is configured in such a manner that the ECU has an abnormality detection portion that detects a data abnormality in the communication portion so as to detect an abnormality when data transmission and reception are disabled due to an occurrence of an abnormality in the communication portion, and that the ECU operates, in the presence of an abnormality, using latest control command values when communications were made normally and determines a failure when an abnormal state has continued for a specific time, and performs a control in such a manner so as to gradually lower an engine rotating speed by decreasing current throttle opening step-by-step to an idle position since a point in time at which the failure was determined for the shift position to be held in a neutral state thereafter. Alternatively, it is configured in such a manner that a control state at the point in time at which the failure was determined is maintained even when the communication portion is restored to a normal state during a failure determination and the data transmission and reception are enabled. Hence, even when an abnormality occurs in communications, the boat will never become unstable. Also, even when the communication line restores to a normal state and the communications are resumed, it is possible to avoid a runaway state that causes an abrupt acceleration state by keeping a failure processing state until the engine of the outboard motor is brought into a stopped state. As a consequence, a safe sailing is enabled.

According to this aspect of the invention, it is configured in such a manner that the ECU gains an understanding of an engine operating state of the outboard motor and constantly monitors whether the engine is operating according to the control command values. Upon detection of an operating state different from the control command values, the ECU determines an abnormal state, and not only stops the engine by transmitting a stop command to the outboard motor with which the abnormality is detected, but also gives a warning of an abnormal state to the boat driver. Hence, when an abnormal operation different from the control command value is detected, the stopping action is taken immediately to the outboard motor with which the abnormality is determined. It is thus possible to prevent the occurrence of a runaway due to an accidental failure state. As a consequence, a safe sailing is enabled.

Various modifications and alterations of this invention will be apparent to those skilled in the art without departing from the scope and sprint of this invention, and it should be understood that this is not limited to the illustrative embodiments set forth herein.

What is claimed is:

1. A control system for a boat equipped with at least one outboard motor and at least one operator station to control a hull, the at least one outboard motor having an engine, a throttle actuator that controls throttle opening for the engine, a shift actuator that controls a shift position to be put into one of neutral, drive, and reverse positions, and an engine control unit that controls the engine, the control system comprising:

an operation input portion to control propulsion of the at least one outboard motor; and an operation quantity computation portion that computes control command values including a start and a stop, the throttle opening, and the shift position of the at least one outboard motor by detecting a steering state of the hull based on a steering input from an operator of the operator station, wherein, both the operation input portion and the operation quantity computation portion being mounted on the operator station, wherein, the operation quantity computation portion transmits the control command values to the at least one outboard motor via a communication portion, and the at least one outboard motor is controlled based on the control command values received for the start and the stop, the throttle opening, and the shift position of the engine, wherein, the at least one outboard motor is distinct from and physically distanced from the operator station, wherein a number of outboard motors, a number of operation quantity computation portions, and an installment location of the engine control unit attached to the boat are registered in the engine control unit as registered information and in the operation quantity computation portion by a remotely located diagnostic unit via the communication portion, wherein the engine control unit and the operation quantity computation portion store the registered information into internal non-volatile memories, and operate according to the stored registered information after a start-up, where the start-up occurs when a power supply is switched ON, and wherein:

at least two operator stations are provided, where one operator station is used as a main operator station and a second operator station is used as a sub operator station;

the operation quantity computation portion is mounted on the main and sub operator stations;

the operation quantity computation portion mounted on the sub operator station detects the steering state of the hull based on the steering input from the operator and transmits the detected steering state to the operation quantity computation portion mounted on the main operator station via the communication portion without computing control command values; and the operation quantity computation portion mounted on the main operator station computes control command values from steering states received from all operator stations to directly control the at least one outboard motor.

2. The control system according to claim 1, wherein:

the operation quantity computation portion of the main operator station, through the registration information received by the diagnostic unit, confirms whether the engine control unit is operating normally at the start-up when the power supply is switched ON, and when one engine control unit and any other operation quantity computation portion fails to reply, the operation quantity computation portion mounted on the main operator station determines a system abnormal state and transmits a warning of an abnormal state to the boat driver.

3. The control system according to claim 1, wherein:

the engine control unit has an abnormality detection portion that detects a data abnormality in the communication portion, thus indicating an abnormal state, when data transmission and reception in the communication portion are disabled;

the engine control unit operates in the presence of the abnormal state, using control command values last received during normal communication and determines a failure of the communication portion when the abnormal state has continued for a specific time, and performs a control to gradually lower an engine rotating speed by gradually decreasing current throttle opening to an idle position from a point in time at which the failure was determined; and the shift position is held in a neutral state when the throttle opening is in the idle position.

4. The control system according to claim 3, wherein:

the throttle opening is maintained in the idle position even when the communication portion is restored to a normal state during a failure determination and the data transmission and reception are enabled.

5. The control system according to claim 1, wherein:

the engine control unit receives an engine operating state and constantly monitors whether the engine is operating according to the control command values, and upon detection of an operating state different from an operating state of the control command values, the engine control unit determines an abnormal state, and wherein, in the abnormal state, the engine control unit stops the engine by transmitting a stop command to the at least one outboard motor for which the abnormality is detected, and transmits a warning of an abnormal state to the boat driver.

6. The control system according to claim 1, wherein the main operator station is located on a deck other than a deck on which the sub operator station is located.

* * * * *